US008829804B2

(12) United States Patent
Radermacher

(10) Patent No.: US 8,829,804 B2
(45) Date of Patent: Sep. 9, 2014

(54) LED LIGHTING CIRCUIT

(75) Inventor: Harald Josef Günther Radermacher, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 142 days.

(21) Appl. No.: 13/519,396

(22) PCT Filed: Jan. 4, 2011

(86) PCT No.: PCT/IB2011/050012

§ 371 (c)(1),
(2), (4) Date: Jun. 27, 2012

(87) PCT Pub. No.: WO2011/083415

PCT Pub. Date: Jul. 14, 2011

(65) Prior Publication Data

US 2012/0286683 A1 Nov. 15, 2012

(30) Foreign Application Priority Data

Jan. 7, 2010 (EP) ..... 10150214

(51) Int. Cl.

| | |
|---|---|
| ***H05B 41/16*** | (2006.01) |
| ***H05B 41/24*** | (2006.01) |
| ***H05B 37/00*** | (2006.01) |
| ***H05B 39/00*** | (2006.01) |
| ***H05B 41/00*** | (2006.01) |
| ***H05B 41/14*** | (2006.01) |
| ***H05B 33/08*** | (2006.01) |

(52) U.S. Cl.

CPC ..... *H05B 33/0815* (2013.01); *H05B 33/0803* (2013.01)

USPC ..... 315/251; 315/185 R; 315/201; 315/250

(58) Field of Classification Search

None

See application file for complete search history.

(56) References Cited

U.S. PATENT DOCUMENTS 5,072,160 A * 12/1991 Yang ..... 315/287
6,285,140 B1 9/2001 Ruston (Continued)

FOREIGN PATENT DOCUMENTS

EP 1675440 A2 6/2006

*Primary Examiner* — Douglas W Owens
*Assistant Examiner* — Dedei K Hammond
(74) *Attorney, Agent, or Firm* — Yuliya Mathis

(57) ABSTRACT

The invention describes an AC-LED lighting circuit (1) comprising an AC-LED arrangement (10) with at least a first set (11) of LEDs connected according to a first polarity and a second set (12) of LEDs connected according to the opposite polarity, which AC-LED lighting circuit (1) is characterized by (i) a source (61) of a polarity-selectable DC input signal (51) to be applied to the AC-LED arrangement (10), or a connecting means (40) for connecting the AC-LED lighting circuit (1) to a fixed-polarity DC input signal (50) and a conversion means (T1, T2, T3, T4) for converting the fixed-polarity DC input signal (50) to a polarity-selectable DC signal (50') to be applied to the AC-LED arrangement (10); and (ii) a polarity controller (70, 71) realized to control the polarity of the polarity-selectable DC signal (50', 51) applied to the AC-LED arrangement (10) such that the first set (11) of LEDs of the AC-LED arrangement (10) is driven when the polarity-selectable DC signal (50', 51) has the first polarity, and the second set (12) of LEDs of the AC-LED arrangement (10) is driven when the polarity-selectable DC signal (50', 51) has the opposite polarity. The invention further describes an AC-LED lighting device (9) comprising such an AC-LED lighting circuit (1) and having an outer chamber (90) enclosing the AC-LED arrangement (10) of the AC-LED lighting circuit (1) and a lamp base (91) at least partially incorporating the connector (3) of the AC-LED lighting circuit (1). The invention also describes a method of driving an AC-LED lighting circuit comprising an AC-LED arrangement (10).

14 Claims, 5 Drawing Sheets

(56) References Cited

U.S. PATENT DOCUMENTS

| | | | | |
|---|---|---|---|---|
| 6,388,393 | B1 | 5/2002 | Illingworth | |
| 7,142,436 | B1 | 11/2006 | Chen et al. | |
| 8,415,892 | B2 * | 4/2013 | Yang | 315/224 |
| 2003/0043611 | A1 | 3/2003 | Backle et al. | |
| 2005/0156540 | A1 | 7/2005 | Ball | |
| 2005/0253533 | A1 | 11/2005 | Lys et al. | |
| 2008/0258643 | A1 | 10/2008 | Cheng et al. | |
| 2008/0265801 | A1 | 10/2008 | Lee et al. | |
| 2008/0285279 | A1 | 11/2008 | Ng et al. | |

* cited by examiner

LED LIGHTING CIRCUIT

FIELD OF THE INVENTION

The invention describes an LED lighting circuit, an AC-LED lighting device and a method of driving an LED lighting circuit.

BACKGROUND OF THE INVENTION

In lighting solutions, LEDs (light-emitting diodes) are playing an ever greater role, made possible by the advances in LED technology in recent years. LED lighting arrangements can be designed to emit white light, necessary for indoor and outdoor illumination purposes, by combining red, green and blue LEDs in solid-state lighting (SSL) solutions. Some LEDs can be coated with phosphor to convert the emitted light into another colour, for example blue 'pump' light can be converted into yellow, green or red light. Such coated LEDs can be combined with non-coated LEDs in an arrangement to give white light. Typically, phosphor-converted white-emitting LEDs are obtained by a combination of phosphor-converted yellowish light and some part of the blue pump light. The development of LEDs with a high light output allows these to be used to replace the comparatively inefficient incandescent light bulbs, which are being phased out. High-power LEDs currently available can produce up to several hundreds of lumens while consuming much less power than conventional incandescent bulbs. For example, the Luxeon Rebel achieves a luminous efficacy of more than 100 lm/W.

The total light output of an LED arrangement depends on the number of LEDs used and the power of the individual LEDs. Since LEDs are semiconductor devices, they are easily combined on a common substrate in a chip package. Present-day LED chips for lighting purposes comprise a number of 'strings' of serially connected LEDs. The number of LEDs in a single string is chosen so that the sum of the forward voltages of the LEDs approximately equals the desired voltage drop across the entire string. Such LED chips can in turn be grouped and mounted onto a light-fitting.

A conventional LED requires a low voltage (in the order of 5 V) and a direct current (DC), whereas mains electricity is high voltage (220V in Europe or 110 V in the USA) and alternating current (AC). To drive conventional LEDs using mains power, full-wave rectification and transformation must be performed to obtain the necessary low-voltage DC signal.

In an alternative approach, an AC-LED chip may be used, i.e. a chip incorporating one or more LEDs and designed specifically to be driven directly using an AC voltage.

Here, the term 'LED' can refer to a light-emitting semiconductor junction, but also to a packaged light-emitting device comprising multiple such junctions. This type of LED does not require a DC converter. An AC-LED chip essentially comprises two strings of series-connected LEDs, connected anti-parallel or inverse-parallel, typically at die level or via bond-wiring of several dies, so that one string is active (emitting light) during a positive half of the current cycle, while the other string is active during the negative half. The semiconductor die is designed so that the forward voltage of each string is approximately equal to the root-mean-square (rms) value of the mains voltage from which the chip is to be driven, and a simple ballast circuitry can be used to limit the current. This 'bipolar' structure gives an integrated reverse polarity protection as well as electrostatic discharge protection. Such AC-LED chips (or simply "AC-LEDs") are becoming interesting for low-cost general illumination. However, the light produced by AC-LEDs driven from the AC mains supply can exhibit an unacceptably high degree of optical flicker, caused by the rapid alteration in polarity at mains frequency. This flicker can be irritating, particularly in the case of indoor lighting applications.

In one approach to this problem, an existing AC-LED chip can be driven instead with a DC current. In such a solution, the AC mains input is smoothed, current limited and surge protected to obtain the required DC signal. The AC-LED chip can be directly connected to this DC signal and driven at a fixed polarity, giving an improved light quality and efficiency of conversion of electrical energy to light. However, in this mode of operation, only one part of the AC-LED chip is continually driven with a forward current, while the other part is continually exposed to a reverse bias voltage and is effectively not used. Assuming the strings comprise essentially equal numbers of LEDs, only 50% of the chip is used to produce light when driven using this method. Apart from the poor utilization, this mode of operation leads to a reduction in lifetime of the AC-LED chip, because, when driven continually with a DC signal, only one of the two strings of LEDs is continually 'stressed' with a drive signal to generate light. The phosphor material used to convert the emitted light is therefore also always 'stressed' in this active string, and will degrade over time more quickly than in an AC-LED, which is driven with an AC drive signal and in which both strings are driven alternately.

SUMMARY OF THE INVENTION

It is therefore an object of the invention to provide an improved way of driving a prior art AC-LED chip with a DC signal.

This object is achieved by the AC-LED lighting circuit of claim 1, the AC-LED lighting device of claim 12, and the method of claim 13 of driving an AC-LED lighting circuit.

The AC-LED lighting circuit according to the invention comprises an AC-LED arrangement, for example in the form of one or more AC-LED chips, with at least a first set of LEDs connected according to a first polarity and a second set of LEDs connected according to the opposite polarity, which AC-LED lighting circuit is characterized by (i) a source of a polarity-selectable DC input signal to be applied to the AC-LED arrangement or a connecting means for connecting the AC-LED lighting circuit to a fixed-polarity DC input signal and a conversion means for converting the fixed-polarity DC input signal to a polarity-selectable DC signal to be applied to the AC-LED arrangement; and (ii) a polarity controller realized to control the polarity of the polarity-selectable DC signal applied to the AC-LED arrangement such that the first set of LEDs of the AC-LED arrangement is driven when the polarity-selectable DC signal has the first polarity, and the second set of LEDs of the AC-LED arrangement is driven when the polarity-selectable DC signal has the opposite polarity.

The AC-LED lighting circuit according to the invention can advantageously be used with either an AC power supply or a DC power supply, depending on its realization. A "source of a polarity-selectable DC signal" can be a suitable converter such as an AC/DC converter incorporated in the AC-LED lighting circuit. Alternatively, the AC-LED lighting circuit can comprise "connecting means" which can be any appropriate electrical connectors for connecting the AC-LED lighting circuit to the fixed-polarity DC signal source. For example, these may be pins or leads positioned where the AC-LED lighting circuit is connected via a printed circuit board or the like to the fixed-polarity DC supply signal. The AC-LED lighting circuit can therefore be realized as a component to be incorporated in a lighting device, or as a complete lighting device product. In the case where the AC-LED lighting circuit might be a complete lighting device, the connecting means can be a plug for connecting it to a corresponding socket, or any appropriate electrical connector.

Since the AC-LED lighting circuit according to the invention can advantageously be driven with a direct current, the light output by the LEDs will not exhibit flicker. A major advantage of the AC-LED lighting circuit according to the invention is that, since the polarity of the polarity-selectable DC signal can be reversed as desired, the set, or string, of LEDs which is to be driven can be chosen, as appropriate, to allow either one of the two strings to be driven. This is in contrast to state of the art applications, wherein the AC-LED chip is either driven using an AC signal—leading to flicker—or driven using a DC signal of constant polarity so that effectively only one half of the chip is used, as already explained in the introduction.

The AC-LED lighting device according to the invention comprises such an AC-LED lighting circuit, and an outer chamber, for example of glass, enclosing the AC-LED arrangement of the AC-LED lighting circuit, and a lamp base at least partially incorporating the connector of the AC-LED lighting circuit, so that the AC-LED lighting device can be directly connected to an AC power supply.

An advantage of the AC-LED lighting device according to the invention is that it can easily be designed to be used as a 'retro-fit' device, for example as a 'light bulb' to be used as a low-energy replacement for an incandescent or halogen lamp with any standard light fitting. A consumer can therefore purchase such an AC-LED lighting device and use it for an existing luminaire or lighting fixture in the same manner as a conventional light bulb.

The corresponding method of driving an AC-LED lighting circuit, comprising an AC-LED arrangement with at least a first set of LEDs connected according to a first polarity and a second set of LEDs connected according to the opposite polarity, comprises the steps of (i) generating a polarity-selectable DC signal to be applied to the AC-LED arrangement, or connecting the AC-LED lighting circuit to a fixed-polarity DC input signal using a connecting means and converting the fixed-polarity DC input signal into a polarity-selectable DC signal to be applied to the AC-LED arrangement; and (ii) controlling the polarity of the polarity-selectable DC signal applied to the AC-LED arrangement such that the first set of LEDs of the AC-LED arrangement is driven when the polarity-selectable DC signal has a first polarity, and the second set of LEDs of the AC-LED arrangement is driven when the polarity-selectable DC signal has the opposite polarity.

The dependent claims and the subsequent description disclose particularly advantageous embodiments and features of the invention.

The AC-lighting circuit according to the invention can be used with any suitable power supply, for example an AC power supply such as the mains power supply (also referred to as household power or wall power) or any AC power supply with a higher or lower voltage than the mains power supply. In the following, without restricting the invention in any way, the terms "AC power supply" and "mains power" may be used interchangeably. The AC-lighting circuit according to the invention can also be used with any suitable DC power supply such as the output of a transformer or a DC-powered emergency lighting bus of appropriate voltage. In the following, the term "polarity" is used in its conventional sense in the context of an electrical circuit, namely that, in a circuit, current flows from the positive pole towards the negative pole. In an AC circuit, the polarity continually alternates between negative and positive, and the current flow direction changes accordingly. A DC circuit has a positive pole and a negative pole, and current always flows in the same direction. In the following, the expression "the polarity of the DC signal" is to be understood to mean the polarity of the DC signal that is applied across at least two nodes of the AC-LED arrangement. In the following, any reference made to the DC signal applied to the AC-LED arrangement assumes a polarity-selectable DC signal, even if this is not explicitly stated.

The AC-LED arrangement can comprise a single AC-LED chip, or a plurality of such AC-LED chips electrically connected in an appropriate manner, depending on the desired light output. The skilled person will be aware that such a chip may have one or more, typically two, pins for connection to a supply voltage. An AC-LED chip, as already outlined in the introduction, comprises essentially two strings of LEDs connected in an inverse parallel manner, also called 'anti-parallel', so that, for a voltage applied between an input node and an output node, only one string conducts electrical current between the input and output nodes. The other string remains reverse-biased, does not conduct, and therefore does not emit light. A 'string' comprises LEDs serially connected in one direction between the input and output nodes, and the skilled person will appreciate that a 'string' could comprise several equivalent strings connected in parallel, several different strings connected in parallel, several sub-strings connected in series, or a combination thereof. For the sake of simplicity, but without restricting the invention in any way, a 'string' in the following may be assumed to comprise a plurality of serially connected LEDs.

Use of the term 'AC-LED chip' should not be interpreted to exclude realizations comprising a plurality of AC-LED chips connected together. The AC-LED chip(s) can be mounted onto a suitable heat-sink, for example an aluminium rod or block. Any suitable configuration can be used when more than one AC-LED chip is being used, for example the AC-LED chips can be mounted onto the heat sink in a linear manner, or in a star arrangement. Depending on the heat generated by the AC-LED lighting circuit when in operation, the heat sink can be designed with additional cooling fins, etc.

The polarity controller effectively imposes or establishes the polarity to be used in driving the AC-LED chip. Seen another way, the polarity controller effectively determines which string of LEDs is driven, and can reverse the polarity at any suitable time, for example according to some random event. Therefore, in a preferred embodiment of the invention, the polarity controller is realized to control the polarity of the polarity-selectable DC signal applied to the AC-LED arrangement according to a random initial condition arising upon connection of the AC-LED lighting circuit to the AC power supply. In a particularly simple approach, the polarity of the AC input voltage at the instant of connection of the AC-LED lighting circuit to the mains supply can be used to set the polarity that is to be applied to the AC-LED chip. The polarity of the AC input voltage can easily be determined using off-the-shelf circuit components, as will be known to the skilled person.

The point in time at which the polarity of the DC signal is reversed may be determined on the basis of the manner in which the AC-LED lighting circuit was previously driven. Therefore, in a further preferred embodiment of the invention, the polarity controller is realized to control the polarity of the DC signal applied to the AC-LED arrangement according to the operating history of the AC-LED arrangement. Here, the term "operating history" is to be understood to mean any information pertaining to the previous operation of the AC-LED arrangement, and can be derived from any measurable parameter such as time, temperature, humidity; a property of the emitted light such as intensity, spectral composition, peak wavelength, colour temperature, etc.; a property of the ambient light to which the AC-LED lighting circuit is exposed, such as the amount of ultraviolet radiation from other light sources; mechanical environmental conditions such as vibration or shock; properties of the supply signal driving the AC-LED lighting circuit such as ripple frequency or amplitude, etc. The operating history can reflect conditions or events that have just been measured, as well as conditions that have been measured and recorded in the past.

In one embodiment of the AC-LED lighting circuit according to the invention, for example, the operating history preferably comprises the polarity of the polarity-selectable DC signal applied to the AC-LED arrangement during an operation period between 'turn-on' and 'turn-off', and the polarity controller is realized to invert or reverse the polarity of the DC signal applied to the AC-LED arrangement upon connection of the AC-LED lighting circuit to the AC power supply in a subsequent operation period. In other words, whenever the light is turned on, the polarity of the DC signal applied to the AC-chip(s) is reversed. This embodiment is particularly suitable for applications in which the lighting device is used in a household environment, and in which the lighting device is not left turned on for overly long periods of time.

In the solution described above, the polarity is reversed whenever the lighting device is connected to the mains supply, for example when a corresponding light switch is activated by a person. In an alternative approach, the polarity can be reversed even during operation of the lighting device, i.e. when the lighting device is turned on. This may be done, for example, to prevent one set or string of LEDs from being stressed for an excessively long period of time.

Evidently, the polarity of the DC signal can be controlled in a more precise way. For example, in a further preferred embodiment of the invention, the polarity controller could be realized so as to invert the polarity of the DC signal after an operation time duration of at least 10 seconds, more preferably after at least 10 minutes, and most preferably after at least 1 hour. In this way, the polarity of the DC signal driving one of the two sets of LEDs is reversed at a predefined point in time so that the other set of LEDs is driven instead. The time between 'reversals' can be chosen according to certain conditions, for example according to the type of AC-LED chips used, the types of phosphor used to coat the LEDs, or other conditions which will be familiar to the skilled person. For instance, while it may be satisfactory to reverse the polarity every 10 hours for some AC-LED chips, other types of AC-LED chip may be driven more optimally if the polarity is reversed every 10 minutes.

To this end, in another embodiment of the AC-LED lighting circuit according to the invention, the overall times that each of the two sets of LEDs are driven are preferably monitored to keep track of the time that each string is actively driven. The operating history can be a digitally stored value or an analogue value representing this time. In an exemplary embodiment, an up/down counter could be used to track an accumulated value representing the time duration that a string is actively driven. The up/down counter can be configured to count up during operation at the first polarity, and to count down during operation at the other polarity. The counter can be configured to increment or decrement at certain time intervals, for example once every 10 seconds, once every minute or any other suitable value, depending on the type of AC-LEDs being used. A previously determined reference value can be used to decide the polarity for the next operation interval of the AC-LED arrangement. For example, the reference value could be zero, resulting, on average, in equal operation times of both polarities. The polarity for the next operating session of the device can be decided by comparing the accumulated value of the counter with the reference value at an appropriate time, for example just before the lamp is turned off, or just after the lamp is turned on.

In another exemplary embodiment, the operating history can comprise a first accumulated duration of operation of the AC-LED arrangement in which the first set of LEDs is driven by the polarity-selectable DC signal, and a second accumulated duration of operation of the AC-LED arrangement in which the second set of LEDs is driven by the polarity-selectable DC signal, and the polarity controller is preferably realized so as to drive the first and second sets of LEDs such that a difference between the first and second accumulated durations satisfies a predefined threshold value. For example, polarity reversals may be effected so that the difference between the accumulated times of the first and second strings is kept below a predefined threshold.

Evidently, there are any number of ways in which such times can be monitored and analyzed to decide on an appropriate time to reverse the polarity of the DC signal. Therefore, in a preferred embodiment of the invention, the polarity controller comprises an analysis unit for analyzing the operating history of the AC-LED arrangement, and is realized so as to control the polarity of the DC signal according to an output of the analysis unit. For example, it may be established that a string should not be driven for longer than an accumulated time of 10 hours. During each operation period of the lamp, the time for which the currently active string is driven is monitored and observed by the analysis unit. Should this accumulated time approach 10 hours, the polarity can be reversed so that the other string is driven instead. In this and subsequent operation periods, the other string can be driven until its accumulated operating time approaches 10 hours. Of course, the techniques described above can conceivably be combined, for example a polarity reversal might be effected on every turn-on of the AC-LED lighting device, and subsequent polarity reversals during that operating period can be based on an elapsed time.

As mentioned above, other measurable parameters such as temperature can be taken into account when determining a suitable switch-over from one string to the other. For example, in a further preferred embodiment, a temperature measurement means can supply the polarity controller with ambient temperature values measured in the vicinity of the AC-LED arrangement. When the temperature is close to the normal room temperature, the accumulation of time is done at a first (normal) rate. When the ambient temperature measured in the vicinity of the AC-LED is higher than normal room temperature, however, the accumulation of time is preferably done at a second, faster, rate. The accumulated time value during the operation of each one of the sets of LEDs is therefore a function of the temperature, so that, if one of the LED strings is known to age faster when operated at high temperatures than the other string, the accumulation rate for this string t at higher temperatures is faster than that for the other string. In this way, operation at higher temperatures will result in an earlier reversal of the voltage, so that the faster ageing of this set of LEDs during operation at higher temperature is to some extent compensated by the reduced operation time of this set of LEDs.

In order to prevent visible artifacts when the polarity is reversed during operation of the lamp, the polarity reversal preferably takes place within a very short time, effectively faster than the transient during the zero crossing of the mains voltage when the AC-LED lighting circuit is used with an AC mains power supply. Such brief transition times ensure little or no visible effect on the light output by the device, particularly when the polarity is reversed during operation. To compensate for a possible 'dip' or 'step' in the light output due to a transition between strings, the amplitude of the drive signal to the AC-LED arrangement can be slightly increased just before and just after the transition process. Alternatively, a kind of pulse-width modulation could be applied during the transition from the previously active string to the string that was previously inactive. Over a certain period of time, for example a "take-over interval" of one minute, the strings can be alternately driven so that the previously active string is driven for progressively shorter lengths of time while the previously inactive string is driven for corresponding progressively longer durations until the string that was previously inactive is continually driven, and the previously active string is now off. In this way, a possible visible artifact which might arise from small physical differences between the strings (for example a slight difference in dominant wavelength due to small temperature differences among the strings) can be rendered unnoticeable.

The features described above—changing polarity upon connection of the lighting device to the mains power supply or according to an operating history—can be realized in a number of ways. For example, one possible embodiment of the AC-LED lighting circuit according to the invention can be realized so as to be connected to an AC power supply such as the mains power, and can comprise a conversion unit to convert the AC mains signal to a polarity-selectable DC signal. In one possible realization, the conversion unit can comprise two bidirectional triode thyristors (TRIACs), a firing signal generator for generating a firing signal, and a firing signal switch for applying the firing signal to one of the TRIACs. In this realization, the polarity controller can comprise a trigger signal generator for generating a trigger signal for the firing signal generator and a switch controller for generating a switch control signal for the firing signal switch. In this realization (which will also be explained with the help of the diagrams), the TRIACs are used to deliver a DC signal with either negative or positive polarity. The polarity of this DC signal is in turn determined by suitable timing of the firing signal and the switch control signal. In other words, this type of realization first 'decides' on the polarity to be used, and then converts the AC input signal accordingly.

When the AC-LED lighting circuit according to the invention is to be realized in a device that is directly connectable to the mains supply, it preferably comprises a power supply connector for connecting the AC-LED lighting circuit to an outlet of an AC power supply. Such a connector can be any suitable connector such as an Edison connector, a bayonet connector, a bipin connector, etc., in a standard design. For example, a standard Edison E27 or E14 connector could preferably be used, so that the AC-LED lighting circuit according to the invention can easily be used as a retro-fit solution for use in existing lighting fixtures. Evidently, a switch may also be used to actually make or break the circuit of which the AC-LED lighting device is a part. Therefore, in the following, the expression "connection of the AC-LED lighting circuit to the AC power supply" can mean the act of connecting the AC-LED lighting circuit to a mains outlet, or the act of closing a switch.

Equally, the AC-LED lighting circuit according to the invention can be realized so as to be connected directly to an available DC power supply, for example a DC signal of fixed polarity generated by a suitable transformer/rectifier unit. In such a realization, the AC-LED lighting circuit comprises a suitable conversion means for converting the fixed-polarity DC input signal into the desired polarity-selectable DC signal. Such a conversion unit can comprise any suitable circuit capable of toggling, inverting or switching a DC signal. For example, one realization can comprise a transistor arrangement for controlling the direction of current flow in the AC-LED lighting circuit. Here, the polarity controller can be realized to electrically connect either the first string of LEDs or the second string to the polarity-selectable DC signal, as desired. A polarity controller can be realized with analogue or digital components, or any appropriate combination. Such a realization, for connecting to an existing constant-polarity DC signal, may be preferred in the case that the AC-lighting circuit is to be produced as a component which can be used in the manufacture of lighting devices. These realizations will be explained below with the help of the Figures.

BRIEF DESCRIPTION OF THE DRAWINGS

Other objects and features of the present invention will become apparent from the following detailed descriptions considered in conjunction with the accompanying drawings. It is to be understood, however, that the drawings are designed solely for the purpose of illustration and not as a definition of the limits of the invention.

In the diagrams, like numbers refer to like objects throughout. Elements of the diagrams are not necessarily drawn to scale. It should be noted that the circuit block diagrams are shown in a very simplified manner.

DETAILED DESCRIPTION OF THE EMBODIMENTS

Figure 1:
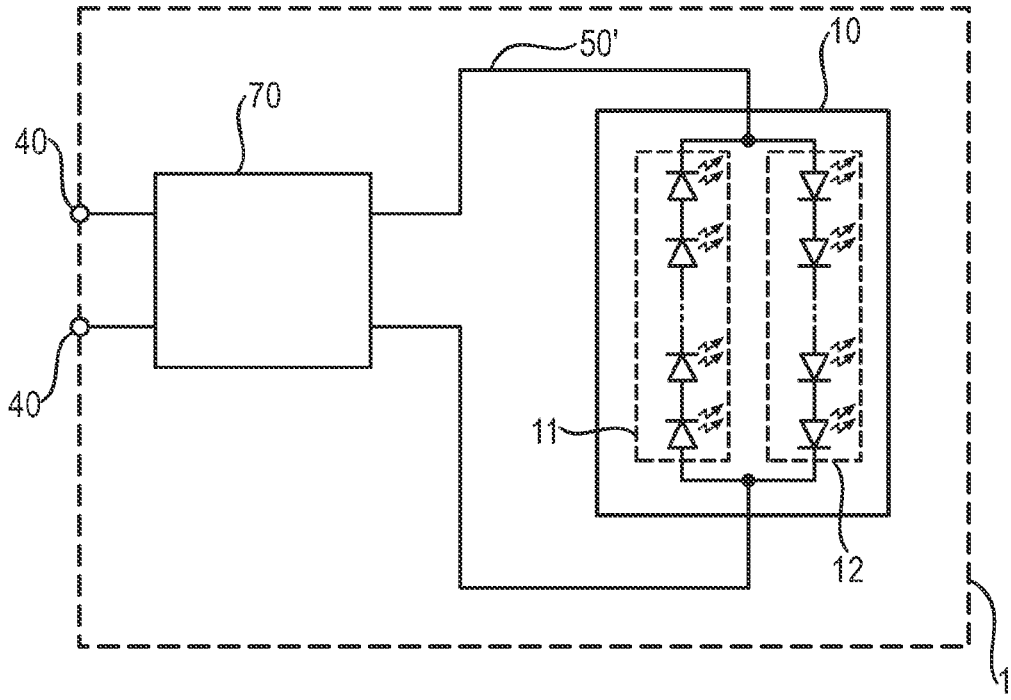
FIG. 1 shows a simplified circuit diagram of a first embodiment of the AC-LED lighting circuit according to the invention.

FIG. 1 shows a simplified circuit diagram in which an AC-LED lighting circuit 1 can be connected, by means of suitable connectors 40, to a DC power supply of constant or fixed polarity. A polarity controller 70 uses the fixed-polarity DC signal to derive or generate a polarity-selectable DC signal 50' which toggles as required between positive and negative polarity and which is applied to an AC-LED arrangement 10. The AC-LED arrangement 10 essentially comprises two strings 11, 12 of LEDs (represented by the standard circuit symbol), connected inverse parallel so that, for an applied potential, one string conducts while the other string is reverse biased. Of course, as the skilled person will appreciate, the AC-LED arrangement 10 can comprise several chips connected in series or in parallel, depending on the desired light output, and any of these chips can comprise more than two strings.

Figure 2:
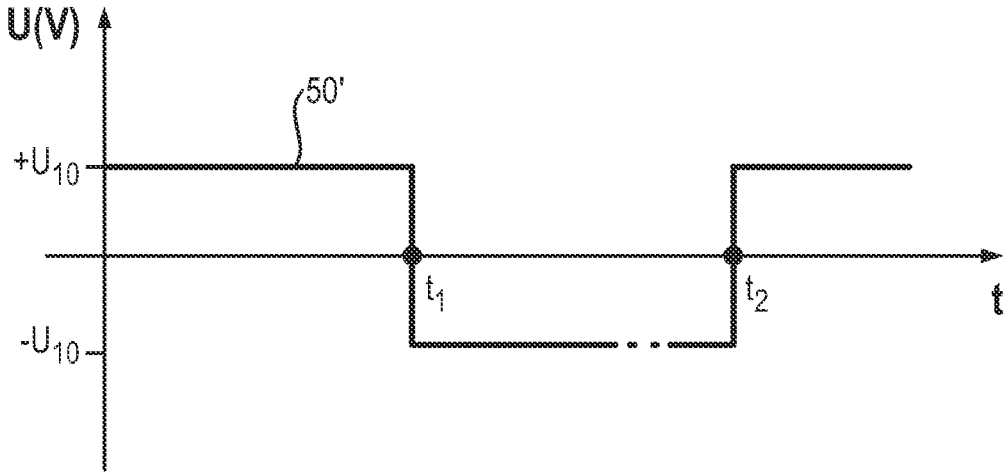
FIG. 2 is a graph of voltage to be applied to the AC-LED lighting circuit of FIG. 1.

FIG. 2 shows an idealized voltage 50' applied to the AC-LED arrangement 10 of FIG. 1. For some length of time, a voltage 50' with a positive polarity and value $+U_{10}$ is applied to the AC-LED arrangement 10. At time $t_1$, the polarity of the voltage 50' is toggled or inverted so that a negative voltage 50' with a value of $-U_{10}$ is applied to the AC-LED arrangement 10. At time $t_2$ the polarity of the voltage 50' is toggled again so that the positive voltage $+U_{10}$ is once more applied to the AC-LED arrangement 10. The polarity of the DC voltage can be toggled whenever the AC-LED lighting device is connected to a power supply, e.g. the mains, or according to an operating history of the AC-LED arrangement 10, as already described above. By reversing or inverting the polarity of the DC voltage 50' applied to the AC-LED arrangement 10 in this way, a favourable light output without noticeable flicker can be obtained, while at the same time it is ensured that the individual strings are not unduly stressed.

Figure 3:
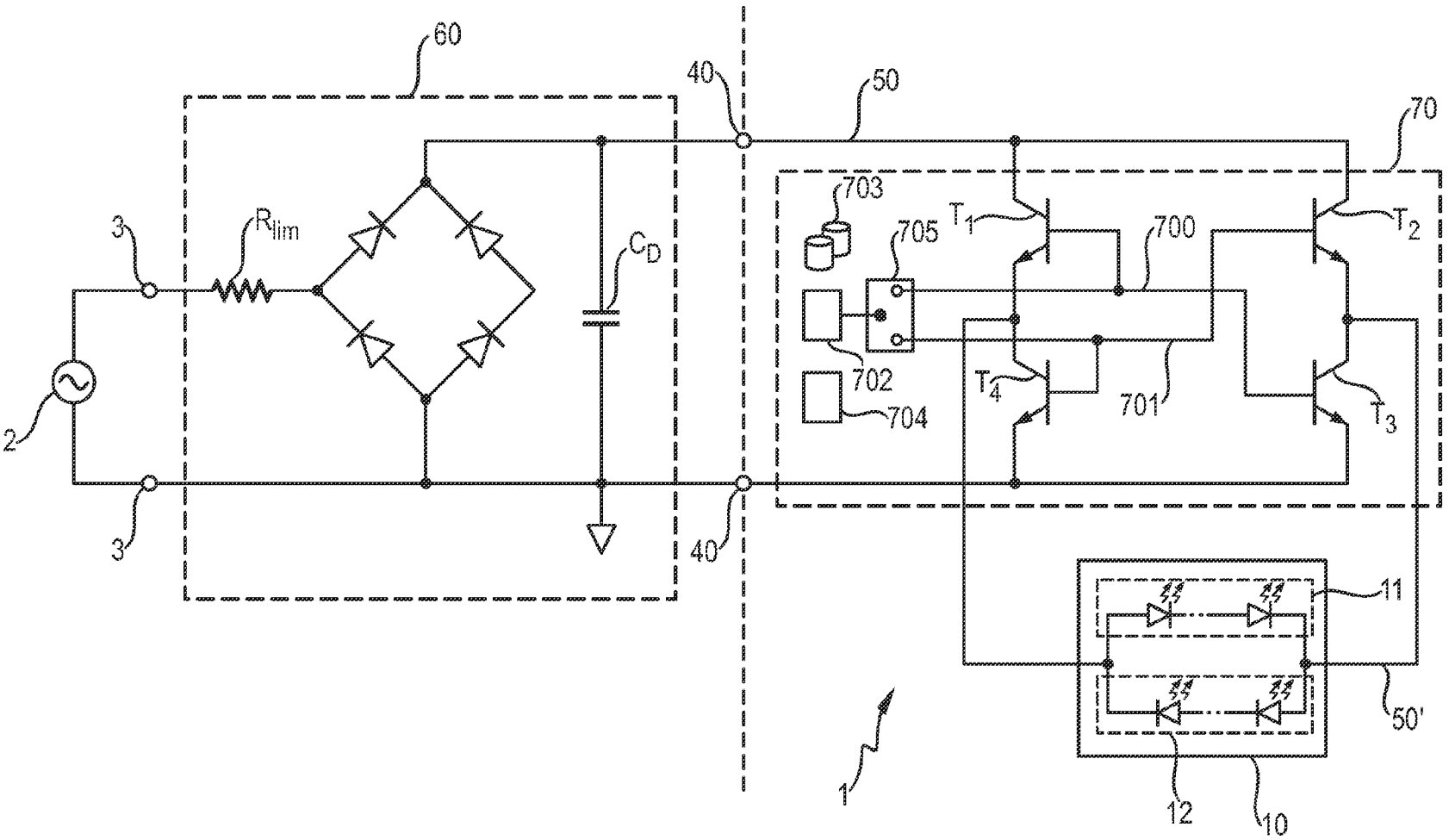
FIG. 3 shows an embodiment of the AC-LED lighting circuit of FIG. 1.

FIG. 3 shows a possible realization of the AC-LED lighting circuit 1 of FIG. 1. Here, the AC-LED lighting circuit 1 (to the right of the vertical dashed line) is connected to a DC source 60 comprising a rectification means—in this case a diode bridge rectifier with a current limiting resistor $R_{lim}$ and a smoothing capacitor $C_D$. The conversion unit 60 serves to convert an AC input voltage (for example the mains voltage from a mains power supply 2 via a power connector 3) into a full-wave rectified, smoothed DC voltage 50 with fixed polarity. In this realization, a conversion means $T_1$, $T_2$, $T_3$, $T_4$ (here shown to be included in the polarity controller 70 unit) converts the fixed-polarity DC signal 50 into a DC signal 50' with selectable polarity which is applied to the AC-LED arrangement 10. Depending on the polarity of the signal 50', either the first LED string 11 or the second LED string 12 is powered or driven with a forward current To control the polarity of the polarity-selectable DC signal 50', the polarity controller 70 comprises a switch 705, the output of which applies a control signal 700 to the gates of a first transistor pair $T_1$, $T_3$ of the conversion means, and a control signal 701 to the gates of a second transistor pair $T_2$, $T_4$. Only one control signal 700, 701 is active at any one time, so that only one transistor pair is turned on. The first transistor pair $T_1$, $T_3$, when conducting, results in a DC voltage 50' being applied to the AC-LED arrangement 10 such that current flows through the first LED string 11 and the second string 12 is reverse-biased. The second transistor pair $T_2$, $T_4$, when conducting, results in the DC voltage 50' being applied to the AC-LED arrangement 10 such that current flows through the second LED string 12 only while the other is reverse-biased. In effect, the transistor arrangement $T_1$, $T_2$, $T_3$, $T_4$, acts as a 'converter' or 'switch' to toggle or flip the supplied DC signal 50 so that a DC signal 50' with switchable polarity is provided. In this embodiment, the switch 705 is controlled by an analysis unit 702 which determines which one of the two transistor pairs should be turned on by the switch 705, i.e. the analysis unit 702 determines the polarity of the DC signal 50'. The analysis unit 702 can use an operating history of the AC-LED arrangement stored in a memory 703. The operating history can comprise, for example, a total operation time for each of the two LED strings 11, 12. The operation times can be summed using a timer 704. For example, if the first LED string 11 has been active for considerably longer than the second LED string 12, the analysis unit 702 can control the switch 705 to cause the DC signal 50' to drive the second LED string 12 instead. In this way, the analysis unit 702 can ensure that the two LED strings 11, 12 are driven in a controlled manner, for example for essentially equally long periods of time. A switchover from one string to the other can be initiated at any time during operation of the AC-lighting circuit, but can equally well be initiated only upon connection of the lighting circuit to the conversion unit 60. Evidently, as already mentioned above, both techniques could be combined, i.e. a polarity reversal might take place every time the AC-LED lighting device is turned on (or otherwise connected to the power supply), and subsequent polarity reversals can then be carried out on the basis of the time spent by each string 11, 12 in active mode. As the skilled person will appreciate, the simplified circuit diagram of FIG. 3 only shows the basic principle of operation of such a circuit. An actual realization might require a power supply unit, a level shifter unit for driving the transistors, dead time generators to prevent cross-conduction of the transistor bridge, and further measures, which, for the sake of clarity, are not shown here. Furthermore, as the skilled person will know, the switch 705 is not necessarily a physical switch; but can be a digital selection controlled by the firmware of a microcontroller of the polarity controller 70. The transistors $T_1$, $T_2$, $T_3$, $T_3$ can be bipolar NPN transistors or any other appropriate switches with suitable blocking voltage and current-carrying capability, such as MOSFETs. The AC-LED lighting circuit 1 shown to the right of the dashed line can be realized as a single component or module, for example with AC-LED chips 10 and circuitry 70 already combined in a finished package with suitable leads or connectors, which package can be used by a lighting-device manufacturer in the manufacture of lighting products. In a highly integrated version, the circuitry 70 can be integrated into the submount carrying the AC-LED chip 10. In a less integrated version, the AC-LED chip 10 and the circuitry 70 are mounted to a suitable carrier, e.g. a printed circuit board.

Figure 4:
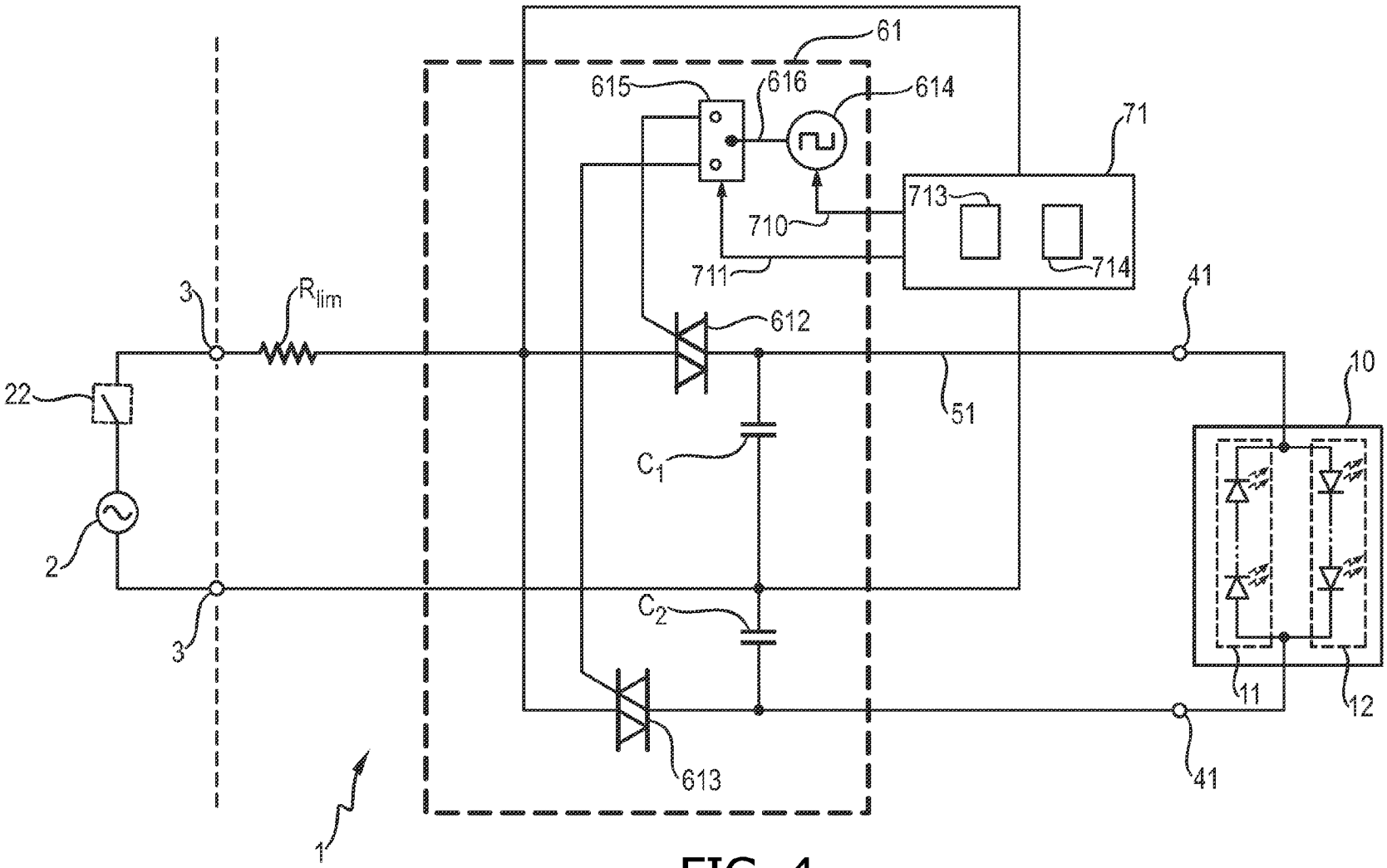
FIG. 4 shows a second embodiment of the AC-LED lighting circuit according to the invention.

FIG. 4 shows an alternative possible realization of the AC-LED lighting circuit 1 according to the invention. In this realization, the AC-LED lighting circuit 1 (to the right of the vertical dashed line) comprises a conversion unit 61 and therefore can be directly connected to an AC power supply 2.

In this embodiment, the polarity controller 71 comprises a zero-crossing detector 713 and a switch controller 714. When the AC-LED lighting circuit 1 is initially connected via a power connector 3 to an outlet of the mains 2—e.g. the light is plugged in directly or switched on by means of a switch 22—the initial polarity of the AC input signal is detected and recorded. The initial polarity, whether negative or positive, is used by the switch controller 714 to generate an initial setting for the switch control signal 711. The zero-crossing detector 713 generates trigger signals 710 upon the zero crossing of the mains voltage. In the conversion unit 61, the trigger signals 710 cause a firing signal or pulse generator 614 to generate a firing signal 616. A switch 615 directs the firing signal 616 to either one of two TRIACs 612, 613 depending on the switch control signal 711. Upon each subsequent zero crossing of the mains voltage, the switch 615 will be toggled, so the firing signals generated by the pulse generator 614 will control both TRIACs 612 and 613 in sequence. The output polarity is determined by the state of the switch 615 and the generated signal 616 relative to the mains voltage. When the circuit commences operating at a certain polarity, the polarity of the output voltage 51 will remain constant or fixed as long as the circuit is connected to the mains voltage. The output of the conversion unit 61 is an essentially DC voltage 51 with selectable polarity—either positive or negative—which is applied to the AC-LED arrangement 10 via the connectors 41.

Figure 5:
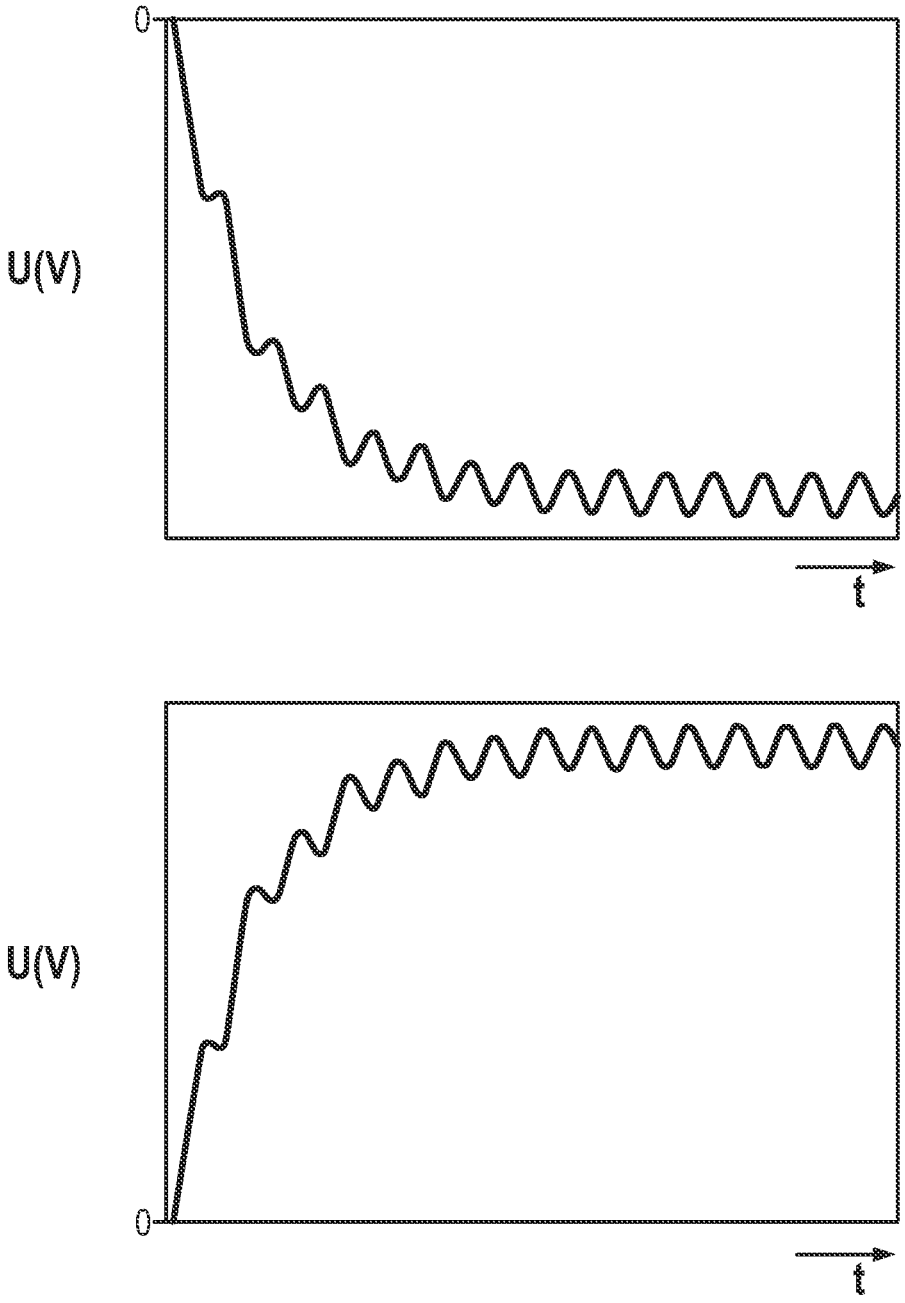
FIG. 5 shows an embodiment of a voltage generated in the AC-LED lighting circuit of FIG. 4.

Other circuit components of the conversion unit 61, such as current limiting resistors $R_{lim}$, $R_1$, $R_2$ and capacitors $C_1$, $C_2$, are required for the correct operation of the circuit, as will be known to the skilled person. Evidently, the polarity controller 71 can also comprise a memory for recording an operating history of the AC-LED arrangement 11, and can comprise further logic blocks for controlling the signal generator and the switch according to the operating history, for example an analysis unit, a timer, etc. The first few milliseconds of the voltage 51 generated by the conversion unit 61 of FIG. 4 are shown in FIG. 5. Depending on the switch control signal 711 and the timing of the firing signal 710, the voltage 51 will be either positive (lower graph) or negative (upper graph). The ripple is due to the frequency of the input AC signal, e.g. 50 Hz for a European household power supply or 60 Hz in the USA and Canada, but does not cause any visible flicker since the peak-to-trough difference in voltage is minor relative to the effective DC operating voltage.

Figure 6:
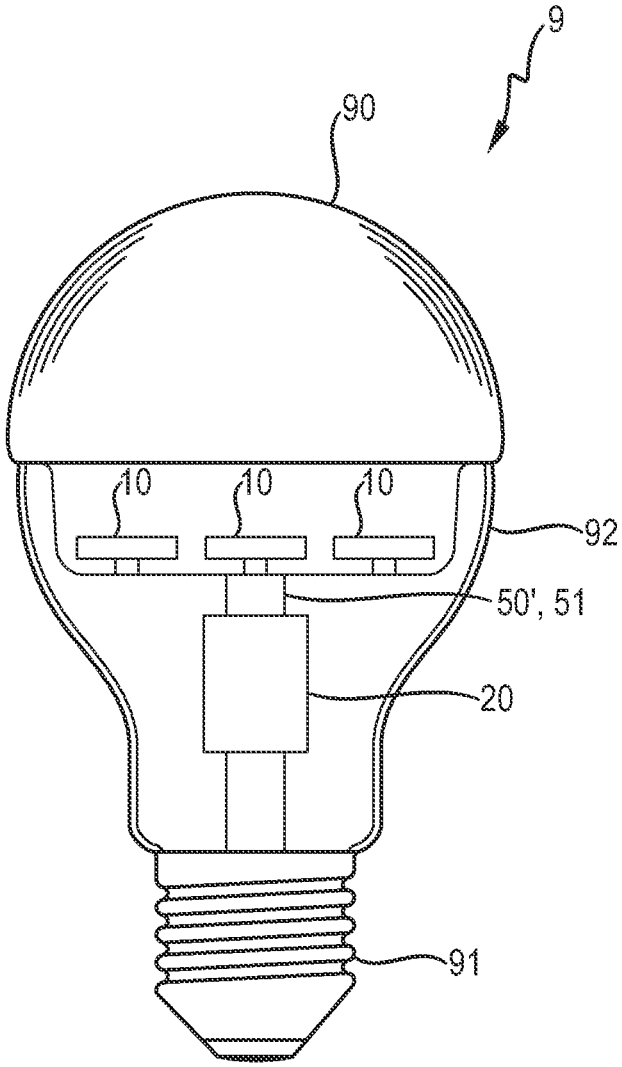
FIG. 6 shows a simplified schematic cross-section of an AC-LED lighting device according to an embodiment of the invention.

FIG. 6 shows a simplified schematic cross-section of an AC-LED lighting device 9 containing an AC-LED lighting circuit within an outer glass envelope 90 or chamber 90 enclosing the AC-LED arrangement 10 of the AC-LED lighting circuit. A lamp base 91 acts as a connector to allow the AC-LED lighting circuit 1 to be connected to the mains power supply. For example, the lamp base 91 can act as the connectors 3 shown in FIG. 5. A polarity reversal arrangement 20 (for example comprising circuitry described in FIG. 3 or FIG. 5) converts the AC mains signal into a DC signal 50', 51 to drive one LED string of each AC-LED chip, and reverses the polarity in any of the ways described above. In this embodiment, the AC-LED arrangement 10 comprises several AC-LED chips 10. In such a realization, the polarity reversal arrangement 20 can comprise a shared polarity controller so that all AC-LEDs are driven with a common DC signal. Equally, the polarity reversal arrangement 20 could comprise several polarity controllers to provide several DC signals which can be applied statically or dynamically to the AC-LEDs. The skilled person will appreciate that a single polarity reversal arrangement 20 could also be realized to provide multiple switchable output polarities for driving a plurality of AC-LED chips. To ensure that the device does not overheat during operation owing to the high junction temperature (which can exceed 130° C.), the chips are mounted on a heat-sink 92. The heat sink 92 in this embodiment comprises a thermally conductive aluminium platform surrounded by an additional cooling arrangement realized as part of the lamp body, which heat sink serves to dissipate heat and which can be equipped with additional cooling fins.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art from a study of the drawings, the disclosure, and the appended claims. For the sake of clarity, it is to be understood that the use of "a" or "an" throughout this application does not exclude a plurality, and "comprising" does not exclude other steps or elements. A "unit" can comprise a number of units, unless otherwise stated. The mere fact that certain measures are recited in mutually different dependent claims does not indicate that a combination of these measures cannot be used to advantage. Any reference signs in the claims should not be construed as limiting the scope.

The invention claimed is:

1. An AC-LED lighting circuit, comprising an AC-LED arrangement with at least a first set of LEDs connected according to a first polarity and a second set of LEDs connected according to the opposite polarity, and (i) a source of a polarity-selectable DC input signal to be applied to the AC-LED arrangement or (ii) a connecting means for connecting the AC-LED lighting circuit to a fixed-polarity DC input signal and a conversion means ($T_1$, $T_2$, $T_3$, $T_4$) for converting the fixed-polarity DC input signal to a polarity-selectable DC signal to be applied to the AC-LED arrangement; and a polarity controller configured to control the polarity of the polarity-selectable DC signal applied to the AC-LED arrangement such that the first set of LEDs of the AC-LED arrangement is driven when the polarity-selectable DC signal has the first polarity, and the second set of LEDs of the AC-LED arrangement is driven when the polarity-selectable DC signal has the opposite polarity, wherein the polarity controller is configured to control the polarity of the polarity-selectable DC signal applied to the AC-LED arrangement according to an operating history of the AC-LED arrangement.

2. An AC-LED lighting circuit according to claim 1, wherein the polarity controller is further configured to control the polarity of the polarity-selectable DC signal applied to the AC-LED arrangement according to an initial condition arising upon connection of the AC-LED lighting circuit to a power source.

3. An AC-LED lighting circuit according to claim 1, wherein the polarity controller is configured to invert the polarity of the polarity-selectable DC signal applied to the AC-LED arrangement after an operation time duration of at least 10 seconds.

4. An AC-LED lighting circuit, according to claim 1, wherein the operating history comprises the polarity of the polarity-selectable DC signal applied to the AC-LED arrangement at the end of an operation period, and the polarity controller is configured to invert the polarity of the DC signal applied to the AC-LED arrangement upon commencement of a subsequent operation period.

5. An AC-LED lighting circuit according to claim 4, wherein the polarity controller comprises an analysis unit for analyzing the operating history of the AC-LED arrangement, and wherein the polarity controller is configured to control the polarity of the polarity-selectable DC signal according to an output of the analysis unit.

6. An AC-LED lighting circuit according to claim 4, wherein the operating history comprises an accumulated duration of operation of a set of LEDs, and the polarity controller is configured to drive the AC-LED arrangement such that the accumulated duration of operation of the set of LEDs does not exceed a predefined threshold value.

7. An AC-LED lighting circuit according to claim 4, comprising a power supply connector for connecting the AC-LED lighting circuit to an outlet of an AC power supply and an AC-conversion unit for converting an AC power supply signal to a DC signal.

8. An AC-LED lighting circuit according to claim 7, wherein the AC-conversion unit is configured to provide a polarity-selectable DC signal to be applied to the AC-LED arrangement and comprises a first bidirectional triode thyristor, a second bidirectional triode thyristor, a firing signal generator for generating a firing signal, and a firing signal switch for applying the firing signal to one of the bidirectional triode thyristors; and wherein the polarity controller comprises a trigger signal generator for generating a trigger signal for the firing signal generator and a switch controller for generating a switch control signal for the firing signal switch.

9. An AC-LED lighting circuit according to claim 7, wherein the AC-conversion unit comprises a rectification means for generating a fixed-polarity DC signal.

10. An AC-LED lighting circuit according to claim 7, wherein the AC-LED arrangement comprises a plurality of electrically connected AC-LED chips.

11. An AC-LED lighting device comprising an AC-LED lighting circuit according to claim 7;

an outer chamber enclosing the AC-LED arrangement of the AC-LED lighting circuit; and a lamp base at least partially incorporating the connector of the AC-LED lighting circuit.

12. An AC-LED lighting circuit according to claim 1, wherein the polarity controller is configured to invert the polarity of the polarity-selectable DC signal applied to the AC-LED arrangement after an operation time duration of at least 1 hour.

13. A method of driving an AC-LED lighting circuit comprising an AC-LED arrangement with at least a first set of LEDs connected according to a first polarity and a second set of LEDs connected according to the opposite polarity, which method comprises (i) generating a polarity-selectable DC signal to be applied to the AC-LED arrangement, or connecting the AC-LED lighting circuit to a fixed-polarity DC input signal using connecting means and converting the fixed-polarity DC input signal into a polarity-selectable DC signal to be applied to the AC-LED arrangement, and (ii) controlling the polarity of the polarity-selectable DC signal applied to the AC-LED arrangement such that the first set of LEDs of the AC-LED arrangement is driven when the polarity-selectable DC signal has the first polarity, and the second set of LEDs of the AC-LED arrangement is driven when the polarity-selectable DC signal has the opposite polarity, wherein the controlling the polarity of the polarity-selectable DC signal applied to the AC-LED arrangement is according to an operating history of the AC-LED arrangement.

14. The method according to claim 13, wherein the polarity of the polarity-selectable DC signal applied to the AC-LED arrangement to drive one of the two sets of LEDs is reversed at the start of an operation period of the AC-LED lighting circuit and/or at a predefined point in time, so that the other set of LEDs is driven instead.

* * * * *